US005963131A

United States Patent [19]

D'Angelo et al.

[11] Patent Number: 5,963,131

[45] Date of Patent: Oct. 5, 1999

[54] ANTI-THEFT DEVICE WITH ALARM SCREENING

[75] Inventors: Michael R. D'Angelo, Melrose, Mass.; Geoffrey M. Eggert, Cape Elizabeth, Me.; Robert G. Bresler, Newton; Joseph E. Qualitz, Stow, both of Mass.

[73] Assignee: Lexent Technologies, Inc., Melrose, Mass.

[21] Appl. No.: 09/129,008

[22] Filed: Aug. 4, 1998

Related U.S. Application Data

[63] Continuation-in-part of application No. 09/099,815, Jun. 19, 1998.

[51] Int. Cl.[6] ..... G08B 13/14

[52] U.S. Cl. ..... 340/568.1; 340/571; 340/686.6; 340/328

[58] Field of Search ..... 340/568.1, 571, 340/572.1, 573.4, 686.6, 539, 529, 328, 502, 505, 825.54

[56] References Cited

U.S. PATENT DOCUMENTS

| | | | |
|---|---|---|---|
| 4,591,835 | 5/1986 | Sharp | 340/574 |
| 4,598,272 | 7/1986 | Cox | 340/539 |
| 4,772,879 | 9/1988 | Hein | 340/571 |
| 5,001,460 | 3/1991 | Basson | 340/571 |
| 5,043,702 | 8/1991 | Kuo | 340/539 |
| 5,126,719 | 6/1992 | DeSorbo | 340/571 |
| 5,196,825 | 3/1993 | Young | 340/573.4 X |
| 5,223,815 | 6/1993 | Rosenthal et al. | 340/539 |
| 5,260,689 | 11/1993 | Meyers et al. | 340/568.6 |
| 5,298,883 | 3/1994 | Pilney et al. | 340/686.6 X |
| 5,317,304 | 5/1994 | Choi | 340/571 |
| 5,406,261 | 4/1995 | Glenn | 340/571 |
| 5,510,768 | 4/1996 | Mann | 340/571 |
| 5,552,773 | 9/1996 | Kuhnert | 340/686.6 X |
| 5,578,991 | 11/1996 | Scholder | 340/571 |
| 5,583,488 | 12/1996 | Sala et al. | 340/568.1 |
| 5,621,388 | 4/1997 | Sherburne et al. | 340/573.4 |
| 5,652,569 | 7/1997 | Gerstenberger et al. | 340/573.4 |
| 5,689,240 | 11/1997 | Traxler | 340/573.4 |
| 5,721,532 | 2/1998 | Lehmann et al. | 340/571 |
| 5,748,083 | 5/1998 | Rietkerk | 340/571 X |
| 5,748,084 | 5/1998 | Isikoff | 340/571 X |
| 5,748,087 | 5/1998 | Ingargiola et al. | 340/686.6 X |
| 5,757,270 | 5/1998 | Mori | 340/568.1 |
| 5,757,271 | 5/1998 | Andrews | 324/568.1 |
| 5,760,690 | 6/1998 | French | 340/571 |
| 5,781,109 | 7/1998 | Nakajima | 340/568.7 X |

*Primary Examiner*—Thomas Mullen

*Attorney, Agent, or Firm*—Chinh Pham; Foley, Hoag & Eliot, LLP

[57] ABSTRACT

A motion sensitive theft detector system for portable articles featuring two way communication between the theft detector unit installed in or affixed to the portable article and the control unit carried by the owner. The theft detector communicates alerts to the control unit allowing the user to screen for false alarms and to trigger an alarm at the portable article when warranted. A second alarm function selected by the mode switch sounds an alarm automatically in response to motion according to an adaptive alarm sequence. The adaptive alarm varies the alarm in response to frequency and duration of motion so that isolated movement triggers a warning but persistent motion triggers a full scale alarm.

30 Claims, 10 Drawing Sheets

ANTI-THEFT DEVICE WITH ALARM SCREENING

RELATED U.S. APPLICATION

The present application is a continuation-in-part of U.S. application Ser. No. 09/099,815, filed Jun. 19, 1998, which is hereby incorporated herein by reference.

TECHNICAL FIELD

This invention relates to alarm systems for portable articles, and in particular to a remotely controlled motion and/or proximity sensitive anti-theft system with a choice of alarm functions including user screening for false alarms and adaptive alarm.

BACKGROUND ART

Theft of valuable small articles continues to be a problem for travelers and others who routinely transport valuable items in the normal course of their daily routines. Briefcases, luggage, portable computer carrying cases, camera bags, and other easily identifiable valuables make attractive targets for thieves. In particular, the theft of laptop computers has increasingly become a problem. Today, there are 50 million laptops in use throughout the world. By the year 2002, that number is expected to increase to more than 100 million. Unfortunately, the increasing popularity of laptop computers has spawned substantial black markets in both stolen computers and stolen confidential business data. These black markets have in part, driven the growth of computer and data theft, with a particularly troublesome effect of making airports notorious for computer theft.

Approaches to theft deterrence have varied in detail but usually consist of different combinations of motion or separation detectors, signaling devices for remote control, and alarm devices. For example, one existing system includes an alarmed luggage strap that triggers an alarm when a would-be thief opens a carrying case or luggage article encircled by the luggage strap. However, the device does not prevent the carrying case from being removed to a remote location before opening. Another approach is to provide an alarm for a security case which can be manually activated by the owner using a remote control. Unfortunately, these devices lack any provision to automatically detect theft attempts and the owner must remain attentive to trigger the alarm when a theft is attempted.

Several known devices trigger an alarm when two units (a detector unit and a transmitter unit) are separated by more than a preset distance. For example, one system discloses a device primarily used to deter kidnaping of a child but which may be used for luggage or other portable goods. This device generates a signal at the control unit and provides for an alarm trigger at the child unit. Other luggage alarm devices trigger alarms automatically when the owner or guardian of luggage (carrying one unit) walks away or is separated from, luggage (containing the second unit). Alarm devices based on separation distance do not distinguish between separation caused by movement of the protected article and separation as a result of the owner walking away temporarily. To protect against an article being removed by a thief, the separation distance at which an alarm occurs should be set as short as practical. However, for these devices to be convenient for routine travel, the distance at which the alarm occurs must be fairly large to avoid false alarms each time the owner places the protected article at rest and walks away to attend to other matters. As a result, the separation distance threshold is usually quite large because most travelers prefer not to have their routines distorted for an anti-theft device. Therefore, with separation distance based alarm devices, a theft attempt may not be detected until the protected article already has been moved a considerable distance from the owner.

Other known devices trigger an alarm when a motion sensing device detects movement of the protected article. Unlike the devices based on separation distance, motion sensing devices respond to an attempted theft instantaneously when the protected article is moved, but prior art motion sensing devices are prone to false alarms because they do not distinguish motion caused by the owner or an innocent passerby in a crowded environment from motion caused by a theft.

There remains a need for a theft deterrent system that is convenient in use, relatively free from false alarms and does not require frequent user action to arm and disarm the system.

SUMMARY OF THE INVENTION

In accordance with one embodiment, the invention provides immediate notification of the movement of a portable article while eliminating the nuisance of false alarms. None of the systems of the prior art combine motion activated response with two-way signaling to enable the user to screen false alarms. The invention also permits the system to be carried in the armed state without nuisance to the owner or others. In another embodiment, the invention uses in combination a motion sensor and a separation distance (i.e., proximity) sensor to reduce incidences of false alarms. With this particular embodiment, an alarm will sound only if both sensors indicate a potential theft. The invention, in a further embodiment, provides a tamper resistant switch without need for a keyed or combination locking switch. In another embodiment, the invention provides an automatic alarm function for when the owner is not nearby to screen false alarms. In another embodiment, the invention provides an adaptive alarm function that reduces the nuisance of false alarms by adjusting the severity of the alarm response to the frequency and duration of movement of the device.

These and other embodiments of the invention will become apparent in light of the specification, claims and drawings.

The invention, in accordance with one embodiment, comprises two units, a theft detector unit to be carried with or installed in/on the protected item and a control unit to be carried or controlled by the owner/user or guardian of the protected article. The system can be armed and disarmed conveniently using the control unit. When armed, the theft detector monitors the protected article for motion, and when motion is sensed, transmits a signal to the control unit, which triggers a small alarm to alert the owner discretely. The owner may then use the control unit to transmit an alarm signal to the theft detector unit, triggering a loud alarm from the protected article, and interrupting a theft in progress. The two-way communication between the control unit and theft detector allows the owner to screen and eliminate false alarms. If a thief attempts to move the protected article, the owner is notified immediately and can sound the alarm on the theft detector. If a passerby jostles the protected article the owner is alerted by the control unit, but a loud alarm can be deferred. The system provides effective theft deterrence without false alarms.

The discrete nature of the motion alert at the control unit makes it possible for the owner to carry the theft detector armed without generating loud alarms. An alert suppression method makes it more convenient to carry the system armed by eliminating repeated alerts for the same movement. For example, if the owner walks with the system, only one alert is issued when the theft detector is first moved, as long as the theft detector keeps moving continuously. The alert suppression method can be based on time intervals between indications of motion. The theft detector sends an alert signal only when motion is detected following a period of a few seconds during which the detector has been stationary. Each time the protected article is moved the owner is alerted, but only once. Thus, the owner can leave the theft detector armed normally. This eliminates the chance that the owner will forget to arm the system after resting the article. When the article is placed at rest, the theft detector is already armed and issues an alert if a theft is subsequently attempted.

In an alternate embodiment, the theft detector unit can be provided with both a motion sensor and a proximity sensor. When armed, the theft detector unit monitors the protected article for motion. Once motion is detected, the proximity sensor sends a signal to the control unit, which is held by the owner, and determines whether the control unit is within a near field proximity (i.e., local proximity) relative to the theft detector unit. If the control unit is within range, the control unit sends confirmation signal to the theft detector unit to indicate that it is within the near field proximity range. If the control unit is not within the near field proximity, a confirmation signal will not be sent in response to the proximity signal from the theft detector unit. In the absence of the confirmation signal, if the system is in automatic mode, an alarm will be sounded immediately to prevent the attempted theft or to alert the owner, if he is within hearing distance, that the security of the article may be compromised. If the system is in a travel mode, in the absence of the confirmation signal, an alert signal is sent from the theft detector unit to the control unit, which triggers a small warning alarm on the control unit to alert the owner discretely. As before, the owner may then use the control unit to transmit an alarm signal to the theft detector unit, triggering a loud alarm from the protected article, and interrupting a theft in progress.

By combining both the motion and proximity detection, the owner is permitted to carry the article in the armed state without generating a false alarm, or false alert on the control unit, despite the constant motion caused by the movement of the owner. This is because the owner, and therefore, the control unit, is always within the near field proximity of the theft detector unit when the article is being carried. The owner, thus, can leave the theft detector armed normally and eliminate the chance that he will forget to arm the system after putting down the article. When the article is placed at rest, the theft detector is already armed and the owner may walk away. If motion is subsequently detected and the control unit is not within the near field proximity, an alarm may sound or an alert signal may be issued to indicate that security of the article is being compromised.

A tamper resistant power mode switch for the theft detector provides security without the use of a locking switch or a numbered keypad. In certain applications, for example, if the theft detector is attached externally to the protected article, the power mode switch may be exposed. In such applications, a power cutoff switch could be used by a thief to defeat the system by turning the system off before moving the protected article. In one embodiment of the invention, the power mode switch does not physically disconnect the remaining components from the power supply. Instead, the theft detector enters a low power mode whereby it draws little current from the power supply. In effect, when in the low power mode, the amount of current drawn from the battery is substantially minimal, so as to not affect the overall shelf-life of the battery. When the power mode switch is placed in the off position, the theft detector can only enter the low power mode if the system is first disarmed by the control unit. If the theft detector is armed when the power mode switch is placed in the off position, the theft detector remains on and armed until the control unit is used to disarm the system. Thus, when the theft detector is armed, the exposed switch cannot be used by the thief to manually turn the system off. Convenient switch operation is retained for the owner, however, who may disarm the system using the control unit before turning the system off.

In one mode of operation, the motion detection system, as well as the combination motion detection and proximity detection system, may automatically sound an alarm. The automatic mode of operation is useful when the owner may be temporarily out of sight or range of the protected article and thus cannot screen for false alarms. The automatic mode sounds the alarm in an adaptive alarm sequence that varies the alarm according to frequency and duration of movement. An isolated movement of the protected article causes only a brief warning burst from the alarm, for example, when bumped by a passerby. A persistent movement of the protected article, as would occur in an attempted theft, causes the alarm to rapidly escalate to a full scale alarm. The adaptive alarm responds to an attempted theft with a full scale alarm, yet reduces the nuisance of false alarms in other circumstances even when the owner is unavailable to screen alarms.

BRIEF DESCRIPTION OF THE DRAWINGS

Features of the invention can be understood more readily by reference to the accompanying drawings in which.

DETAILED DESCRIPTION OF SPECIFIC EMBODIMENTS

The systems illustrated herein can include a pair of units, comprising a theft detector unit and a control unit. Both units can be compact and light weight. As will be seen from the following description, the paired units provide an anti-theft device that employs two-way communications between the control unit operated by a user and the theft detection unit carried with the article being protected.

Figure 1:
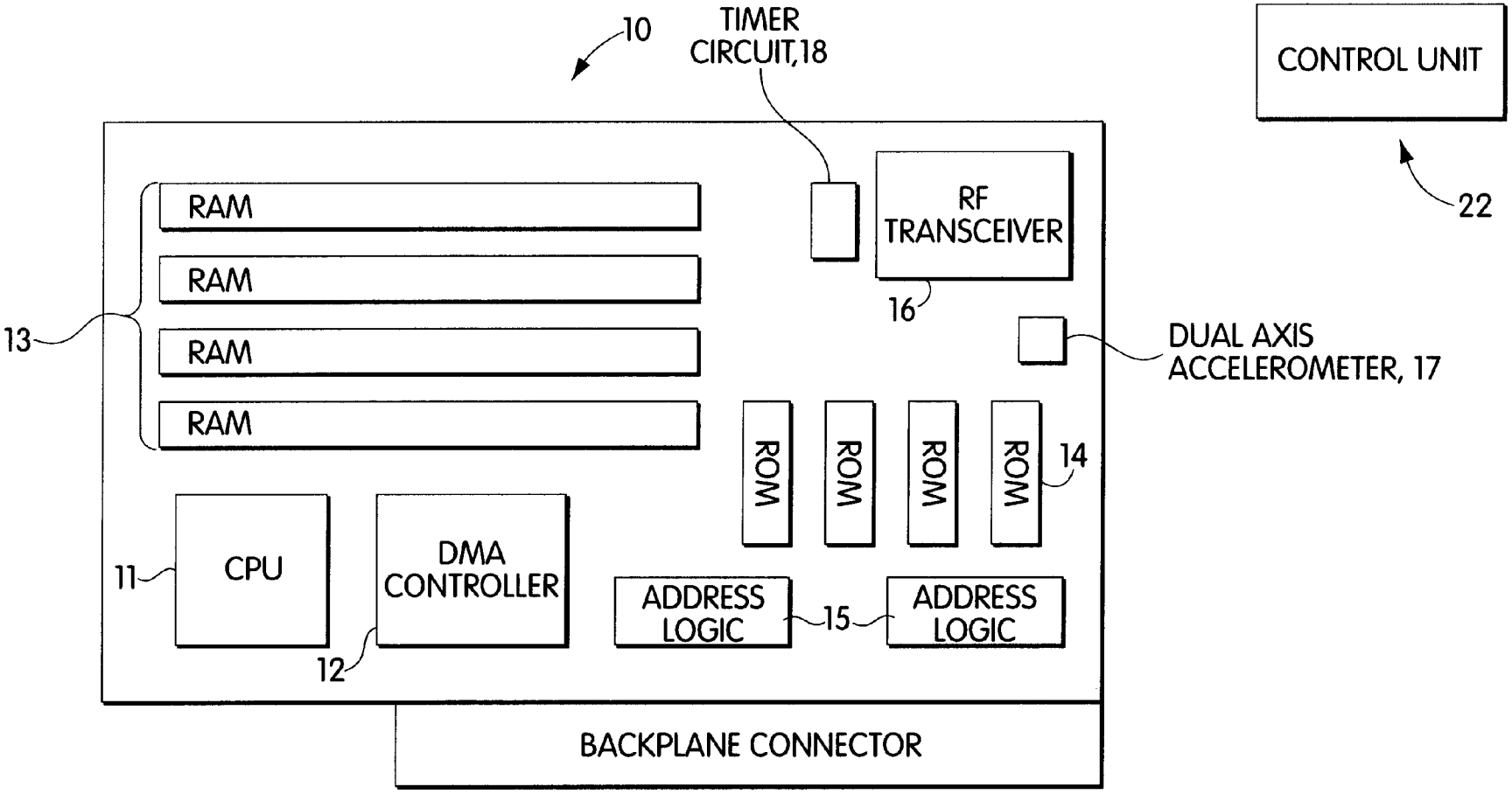
FIG. 1 is an illustration of a computer motherboard that includes a radio-frequency transceiver.

FIG. 1 illustrates an anti-theft system that includes a motherboard 10 and a separate control unit 22. In this embodiment, the theft detector unit is integrated into the motherboard 10 of a laptop computer, and the laptop owner carries the control unit 22 on their person to maintain two-way communication with the laptop. Although the embodiment depicted in FIG. 1 will be described with reference to a laptop computer system, it will be understood that the systems and methods described herein have other applications, including anti-theft systems for desktop computer systems, with central, or wall mounted control units. It will be apparent to one of ordinary skill in the art that the motherboard 10 of FIG. I is depicted as an arrangement of hardware components including the CPU 11 and the timer 18. However, it will be apparent that the components shown in FIG. 1 are merely representative of components that can be employed in the systems described herein and that other components, including hardware devices, software devices and combinations thereof can be substituted therefor. For example, the timer 18 can be implemented through code running under the CPU 11. Other modifications and substitutions can be made without departing from the scope of the invention.

The depicted motherboard 10 includes a CPU 11, a DMA controller 12, random access memory (RAM) 13, read-only memory (ROM) 14, address logic 15, a radio frequency transceiver 16, a dual axis accelerometer 17, and a timer circuit 18. The CPU 11, RAM 13 and ROM 14 can comprise any of the commercially available chip sets that can be arranged for providing a general purpose computer system. The CPU 11 RAM and ROM cooperate to execute instructions stored as programs in the ROM 14 or in a persistent memory device (not shown), such as a hard drive coupled to the motherboard 10. The RAM 13 provides a data memory that can be employed by the CPU during execution of a computer program. Under the control of a computer program executing on the motherboard 10, the theft detector unit can exchange data and command signals with the control unit 22, which will be described in greater detail with reference to FIG. 3, to provide an anti-theft system that can warn a user that the motherboard 10 is being moved without authorization.

To this end, the transceiver 16 can be a radio-frequency transceiver having a transmitter and a receiver formed on the circuit board. The transceiver 16 is capable of transmitting and receiving radio frequency signals for communicating with the control unit 22, or any R-F device. The transceiver can comprise integrated circuit components mounted to the motherboard 10. Alternatively, the transceiver 16 can be formed from discrete components, including capacitors, inductors, resistors, transistors and other common elements that are incorporated onto the motherboard 10, as well as from a combination of integrated circuits and discrete components. The design and development of such R-F front end circuits is well known in the art of electrical engineering.

The transceiver 16 can couple to the bus of the motherboard 10 for allowing communication with and control by the CPU 11. In one embodiment, the motherboard 10 includes a 32-bit data bus that can be employed for transmitting control and data words to and from the transceiver 16. The transceiver 16 can include a logic circuit for processing data and control words received from the CPU 11 thereby allowing the CPU 11 to control the R-F transmission and reception of data signals. Although the depicted transceiver 16 is shown as part of the theft detector unit, it will be understood that the transceiver 16 can be a general purpose transceiver unit carried on the motherboard 10 and employed for general R-F data communications, including communications for modem data transfer, LAN data transfer, or any other application that employs R-F data transfer. In one embodiment, the transceiver 16 has a range of about 300 feet, however, transceiver range can be adjusted or selected according to the application. In other embodiments, the transceiver 16 comprises an IR communication device for IR exchange of data signals that can be representative of commands and data employed for operating the anti-theft system. In further embodiments, the transceiver 16 includes a satellite data communications device, or cellular data telecommunications device, a modem communications device, or any other wireless communication device or device for transferring data signals over a communications network.

The accelerometer 17 can be a dual axis accelerometer of the type employed for detecting motion along two axes, such as the ADXL 250 manufactured and sold by the Analog Devices of Norwood, Mass. The accelerometer can be coupled to the CPU 11 for generating an interrupt that signals the CPU that motion was detected. Alternatively, each time the accelerometer 17 detects movement, the accelerometer can set a flag in a data register that the CPU 11 periodically reads, and it will be apparent to those of ordinary skill in the art that other techniques can be employed for collecting and storing information regarding detected movement of the motherboard 10. It will be further apparent to one of ordinary skill in the art that other motion detectors can be employed including single axis accelerometers, triple-axis accelerometers, rolling ball motion detectors, or any other suitable device.

In the depicted embodiment, the theft detection unit includes a timer circuit 18 that can be a conventional digital logic counter coupled to the system clock of the motherboard 10, with an optional programming feature that allows for selectively changing the time period being marked by the timer. To this end, the timer circuit 18 can couple to the CPU 11 via the bus to receive data and control signals. The CPU 11 can set the count-down value that the timer circuit 18 decrements during each clock cycle. Accordingly, the CPU 11 can select the time period monitored by the counter circuit 18, which in one practice can be in response to a data signal sent by the control unit 22 and representative of an instruction that directs the CPU 11 to set the timer for a long, short or zero time delay. After the counter circuit 18 has finished counting down, the timer circuit 18 can send an interrupt to the CPU, or can set a flag within a data register that can be read periodically by the CPU 11, or can use any suitable technique for signaling the CPU 11 that the selected time period has elapsed.

Optionally, the motherboard 10 can include a back-up battery capable of acting as a secondary power supply for powering the theft detector and any sirens or alarm devices controlled by the theft detector. The back-up battery can be a rechargeable battery that provides an additional power supply to reduce the possibility that a thief would remove the laptop battery to disable the theft detector unit.

Figure 2:
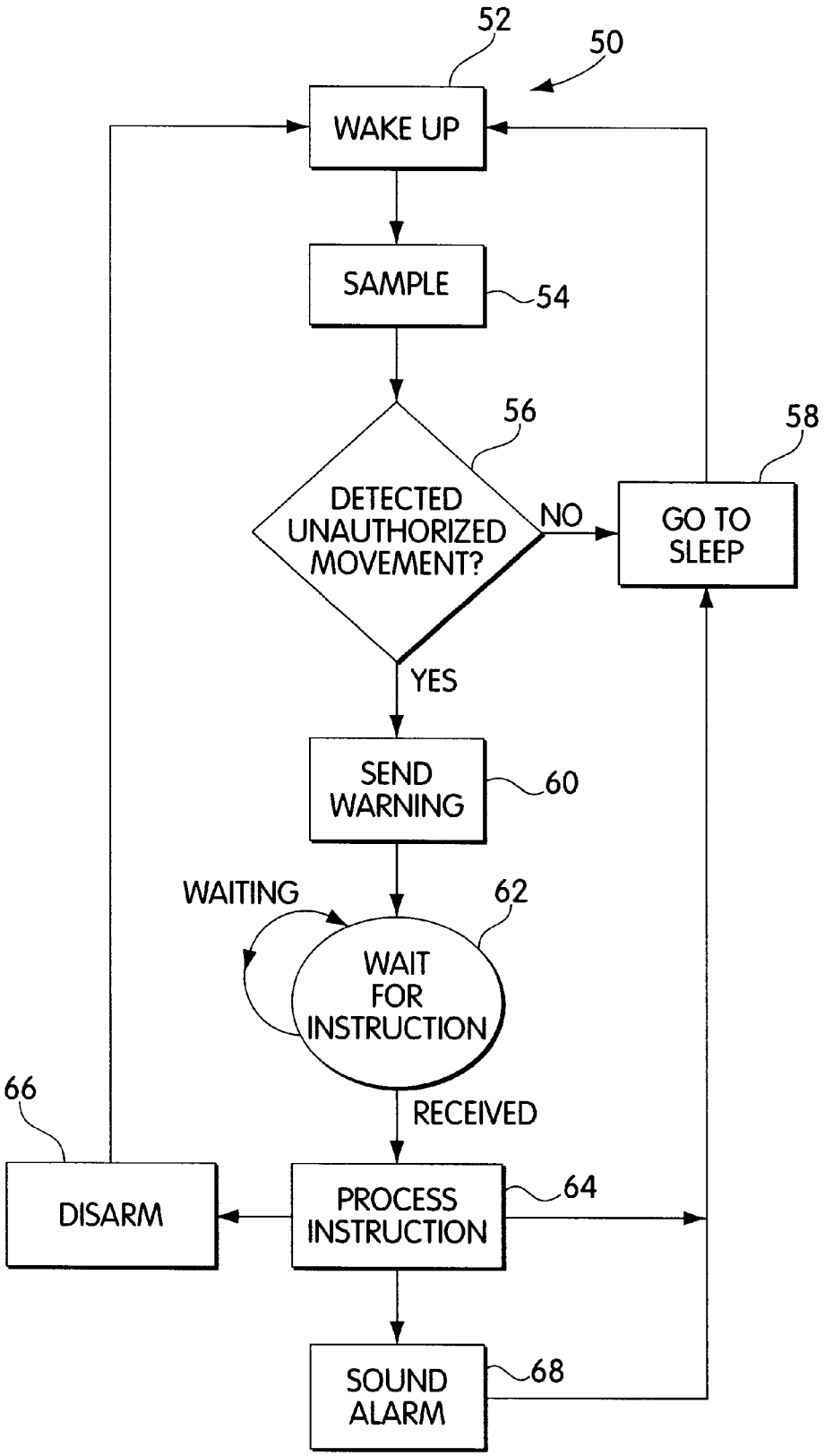
FIG. 2 is a flowchart of one process that can be carried out by a computer program running on a computer having the motherboard of FIG. 1.

In the embodiment depicted above, the program running on the motherboard 10 can control the elements depicted in FIG. 1 to provide a theft detector unit that can generate an alert, or warning signal in response to a detected movement of the motherboard 10. One such program is depicted by the flowchart diagram of FIG. 2. Specifically, FIG. 2 depicts a flowchart diagram of a process 50 that coordinates the elements of the motherboard 11 to detect unauthorized movement of the laptop. The process 50 includes a first step 52 wherein the CPU 11 "wakes up" from a low power mode. Typically, the anti-theft system is operating when the CPU 11 is in a low power state, which extends battery life but reduces the available processing capabilities of the CPU 11. Accordingly, in the process 50 a first step is to place the CPU 11 in a state sufficient for processing data. In one practice, the process 50 places the CPU 11 in such an active state approximately once every 200 milliseconds.

Once the CPU 11 is activated, the process 50 proceeds to step 54, wherein a data register is read, or sampled. The data register can store flag signals representative of events that have occurred since the last time the CPU 11 read the data register. The data register can be any memory location in the RAM 13, or a specific hardware register mounted on the motherboard 10, or can be any suitable data storage device or devices available to the system. The stored flag signals can include a movement detection flag, a timer flag, an armed/disarmed flag or any other flag representative of information that can be useful to the process.

After sampling the data register, the process 50 proceeds to step 56, wherein the program processes the data collected to determine if any unauthorized movement has occurred. To this end, the process 50 can determine whether the accelerometer 17 has detected motion and can also check the state of the armed/disarmed flag. If the movement flag indicates that no movement has been detected or if the armed/disarmed flag is set to disarmed, then the process 50 determines that no unauthorized movement has occurred and the process proceeds to step 58, wherein the CPU 11 is placed into a low power mode.

Alternatively, if movement has been detected and if the armed/disarmed flag has been set to indicate the system is armed, the process 50 proceeds to step 60. In step 60, the process 50 instructs the transceiver 16 to send an alert signal to the control unit 22. The process 50 can then proceed to step 62, wherein the process 50 will wait for an instruction, which can be an R-F data signal sent from the control unit 22 and received by the transceiver 16. In one practice, the process 50 will cause the transceiver to resend periodically the alert signal while waiting for the instruction. Other steps can also be taken to prompt the user to send an instruction or to take a default action in absence of an instruction. Once an instruction is received, the process 50 proceeds to step 64 to process the instruction. In step 64 the process 50 determines whether the user has directed the system to sound the alarm, ignore the movement, or to disarm in step 66 the anti-theft system.

If the instruction directs the theft detection unit to sound the alarm, then the process 50 can proceed to step 68 and a siren (not shown) can be activated. It will be noted that in the depicted embodiment, the siren can be powered by the laptop computer battery which can provide power sufficient to operate a high-performance siren. Alternatively, the instruction can direct the process to step 58, where the system will ignore the movement and go to sleep. Alternatively, the user can send a signal to disarm the alarm, wherein the CPU 11 can set the disarm flag in the data register. This will deactivate the alarm until the alarm is rearmed.

Figure 3:
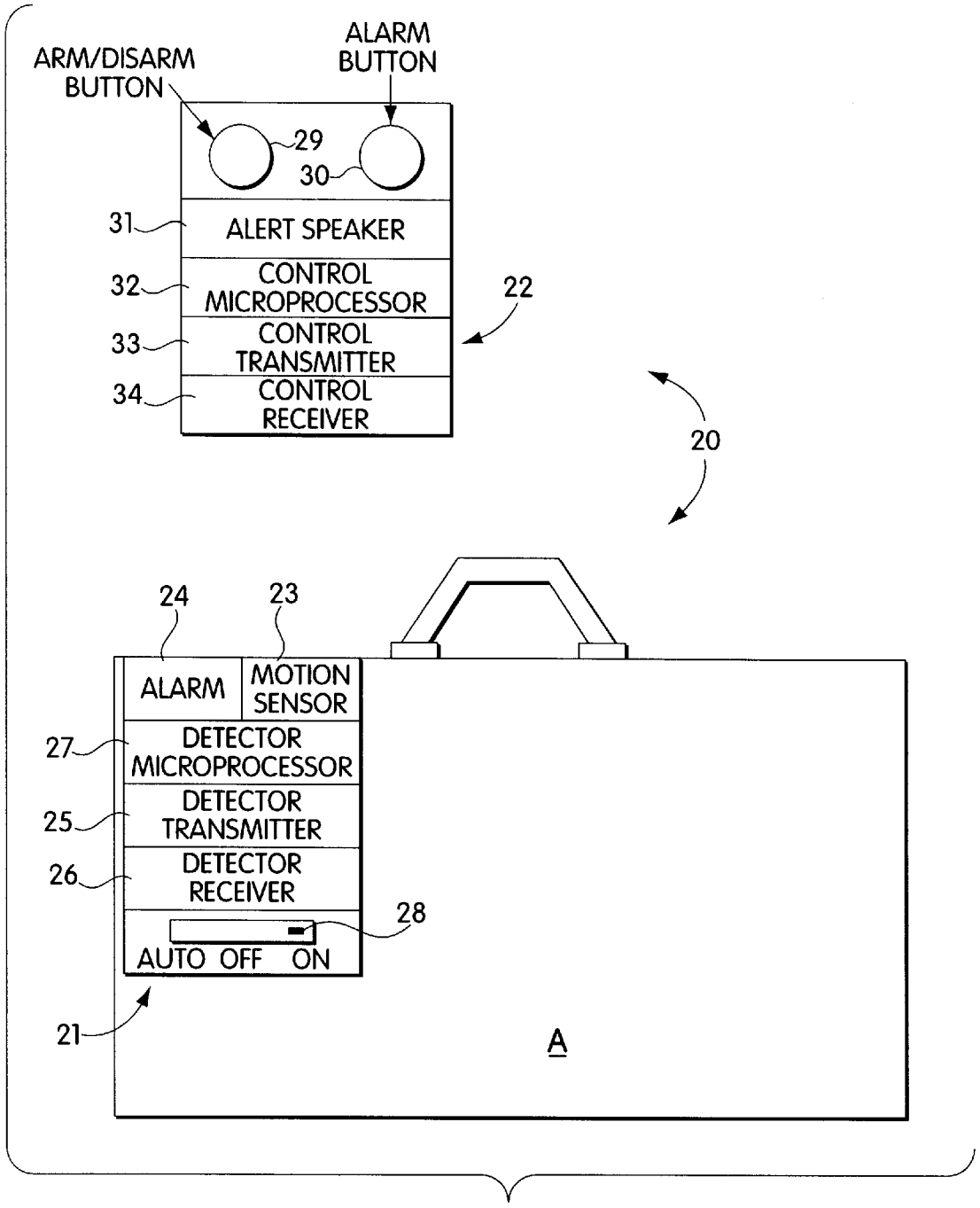
FIG. 3 is a diagram showing major components of the theft detector unit and control unit in one embodiment of the invention as installed in a carrying case.

An alternative embodiment of a theft detector is shown in FIG. 3. This system includes a theft detector 21, housed in or affixed to a briefcase A, and a remote control unit 22. Attachment to the computer can be by hook and loop fastener, bracket, lock or any other suitable mounting mechanism. The detector includes motion sensor 23, alarm 24, detector transmitter 25, detector receiver 26, detector microprocessor 27, and mode switch 28 with position indicators automatic, off, and on. The control unit 22 includes the arm/disarm button 29, an activation device depicted as an alarm button 30, a warning device depicted as alert speaker 31, control microprocessor 32, control transmitter 33 and control receiver 34. Power is supplied in each unit by batteries which have been omitted from all figures for simplicity.

The primary operating mode of theft detection system 20 is selected by placing mode switch 28 in the on position. Generally, theft detector 21 detects a possible theft attempt when motion sensor 23 detects movement of briefcase A after it has been at rest for a brief time interval. The motion sensor 23 can be an electromechanical device that creates an output in response to a vibration or acceleration of the sensor, for example, when the protected article is first picked up and moved or with each step when the article is being carried by a person who is walking. Motion sensor 23 must be able to detect movement regardless of its initial orientation. Several such motion sensor designs are known and commercially available.

When armed, theft detector 21 notifies the owner of movement by sending a coded radio frequency alert signal through detector transmitter 25 to control receiver 34 which, in turn, activates the alert speaker warning device 31 of control unit 22, notifying the user who may optionally trigger the alarm 24 if appropriate. Alert speaker 31 may be any device that produces a low-level audible alert and in some cases may be supplemented or replaced by a visual indicator, for example, an LED, or tactile indicator, such as a vibrator. In one embodiment, alert speaker 31 is a small piezoelectric sounding device that produces a chirp or beep when activated.

Figure 6:
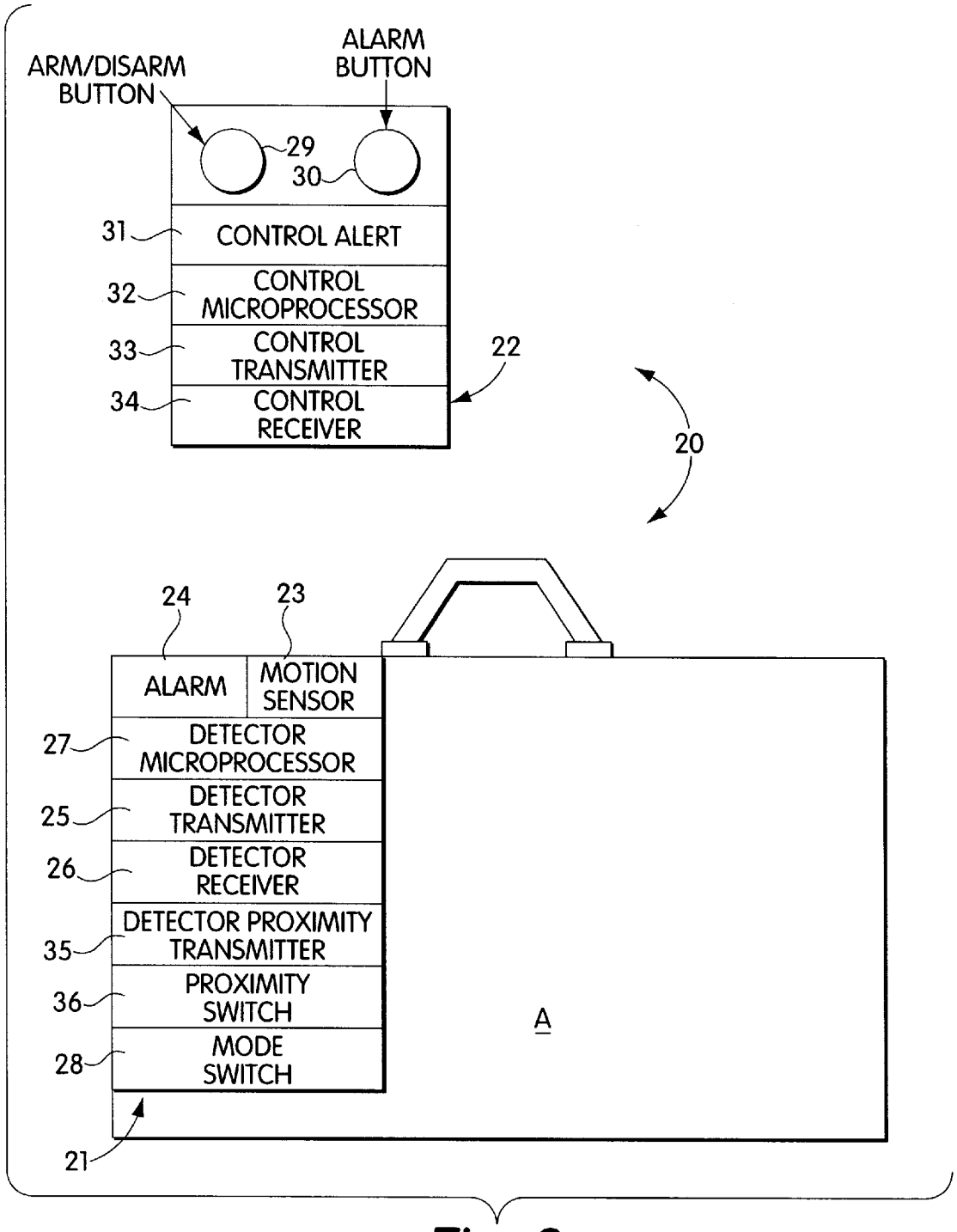
FIG. 6 illustrates an alternate embodiment of the theft detector unit shown in FIG. 3.

Another embodiment of the theft detector is shown in FIG. 6. This theft detector 21 is substantially similar to that shown in FIG. 3, but includes an additional detector proximity transmitter 35 and a proximity switch 36. As with the embodiment of FIG. 3, the theft detector 21 in FIG. 6 can operate either in an automatic alarm mode (with mode switch 28 in the automatic position) or in a travel mode (with the mode switch 28 in the on position).

Still referring to FIG. 6, with the mode switch 28 in the on position, the theft detector 21 detects a possible theft attempt when motion sensor 23 detects movement of briefcase A. However, unlike the embodiment shown in FIG.3, the owner does not get notified of the movement at this point. Once movement has been detected, and the proximity switch 36 is activated, the proximity transmitter 35 sends out a coded proximity check signal having a known pattern to the control receiver 34 in the control unit 22. In one embodiment, the proximity signal may be about 45 db microvolts per meter or less and may have a near field proximity of, for example, approximately 15 feet in radius, which can be appropriately adjusted if so desired. If the control unit 22 is within the near field proximity, in response to the proximity check signal, a confirmation signal is sent from the control transmitter 33 to the detector receiver 26 in the detector unit 21. As indicated previously, the detector receiver 26 and detector transmitter 25 may be a single transceiver unit or be separate discrete components as shown in FIG. 6.

To determine whether the control unit 22 is within the near field proximity, methods well known in the art may be employed. For instance, the proximity transmitter 35 may send out a signal of a certain strength having a near field proximity with a set radius. If the control unit 22 is within the set radius, the proximity signal will be received by the control receiver 34 and a confirmation signal will be transmitted from control transmitter 33 of the control unit 22 to detector receiver 26 of the theft detector 21. Otherwise, the proximity signal will not be received by the control receiver 34 and a confirmation signal from the control transmitter 33 will not be returned.

Another manner in which proximity may be determined is to employ a signal strength indicator. In this method, a proximity signal of a specific strength is first transmitted from the proximity transmitter 35 to the control receiver 34. Depending on the distance at which the control unit 22 is located relative to the theft detector unit 21, an attenuated signal will be received by the control receiver 34. The strength of the attenuated signal is then measured and compared to the strength of the original proximity signal. An estimate of the relative range between the control unit 22 and the theft detector unit 21 is thereafter calculated by taking the product of the measured attenuated signal and a predetermined calibration constant. A calibration constant is defined in the context of the present invention as a number which when multiplied by the signal strength yields a proximity range. For example, if the signal strength is 0.001 watts and the calibration constant at this power level is 10,000 meters per watt, then the relative range is (0.001 watts)·(10,000 meters/watt), or 10 meters. If this estimated relative range is within the near field proximity, a confirmation signal will be transmitted from control transmitter 33 of the control unit 22 to detector receiver 26 of the theft detector 21. This method of measurement, in one embodiment, uses a special detector chip (not shown) to receive and measure the strength of the proximity signal. Such a chip is preferably made available in the control unit 22, but may alternatively be provided in the theft detection unit 21 so that the control unit may also receive and measure the signal strength for comparison. The detector chip is commercially available as model number HP-900 from Linx Technologies, Inc. located in Grants Pass, Oreg.

If the control unit 22 is outside the near field proximity, a confirmation signal from the control transmitter 33 will not be issued. In the absence of a confirmation signal, the theft detector 21 notifies the owner of movement by sending a coded radio frequency alert signal through detector transmitter 25 to control receiver 34. The alert signal, in a preferred embodiment of the invention, is generally of a higher strength/power than the transmitted proximity check signal. The control receiver 34, in turn, activates the alert warning device 31 of control unit 22, notifying the user that security of the briefcase may be compromised. The owner may thereafter optionally trigger the alarm 24 if appropriate. It should be understood that although the discussion refers to a proximity check signal originating from the theft detector 21, such flnction may be easily adapted to originate from the control unit 22. In such a situation, the measurement of proximity signal and estimation of the relative range maybe accomplished by the theft detector unit 21.

To conserve energy, detector microprocessor 27 may be provided, in accordance with an embodiment of the invention, with timing information for use in connection with the proximity transmitter 35, so that a proximity check signal will not be transmitted for every single motion detected. Such a system is further described hereinafter.

Although a discrete proximity transmitter 35 is provided in connection with the embodiment of FIG. 6, it is contemplated that the functions of the proximity transmitter 36 and the functions of the detector transmitter 25 may be incorporated into a single unit. In such an embodiment, a switch may be employed to permit this single unit to appropriately switch between the proximity signal function of the proximity transmitter 36 and the alert signal function of the detector transmitter 25.

For the ease of discussion, it should be understood that the components referenced hereinafter are directed both to the motion sensing only embodiment (FIGS. 3-4) and the motion and proximity embodiment (FIGS. 6-7), unless otherwise indicated. Control unit 22, in FIGS. 3 and 6, communicates and cooperates with theft detector 21. The arm/disarm button 29 causes control unit 22 to send a signal through control transmitter 33, that when received by detector/receiver 26 causes theft detector 21 to activate or deactivate motion sensor 23. Alarm button 30 causes control transmitter 33 to send an alarm signal which, when detected by detector/receiver 26, activates alarm 24. Thus, when alert speaker 31 is activated by an alert signal from theft detector 21, the user of the theft detection system may respond by pressing alarm button 30, triggering alarm 24 of theft detector 21, thereby startling a thief and summoning others to aid in thwarting a theft.

Figure 4:
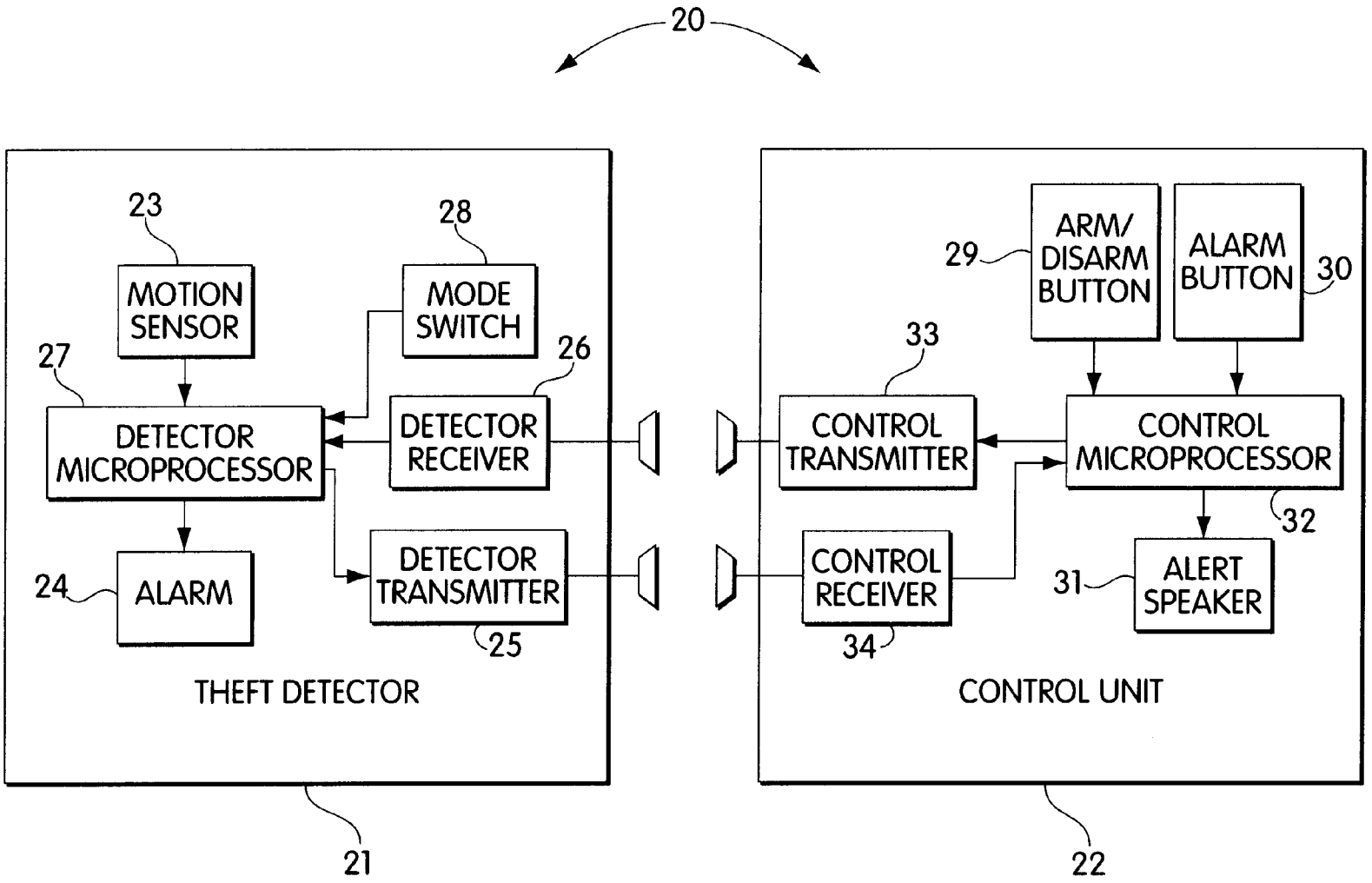
FIG. 4 schematically represents the connectivity between elements of the theft detector and control units in the embodiment of FIG. 3 and the flow of information and control within and between the units.
Figure 7:
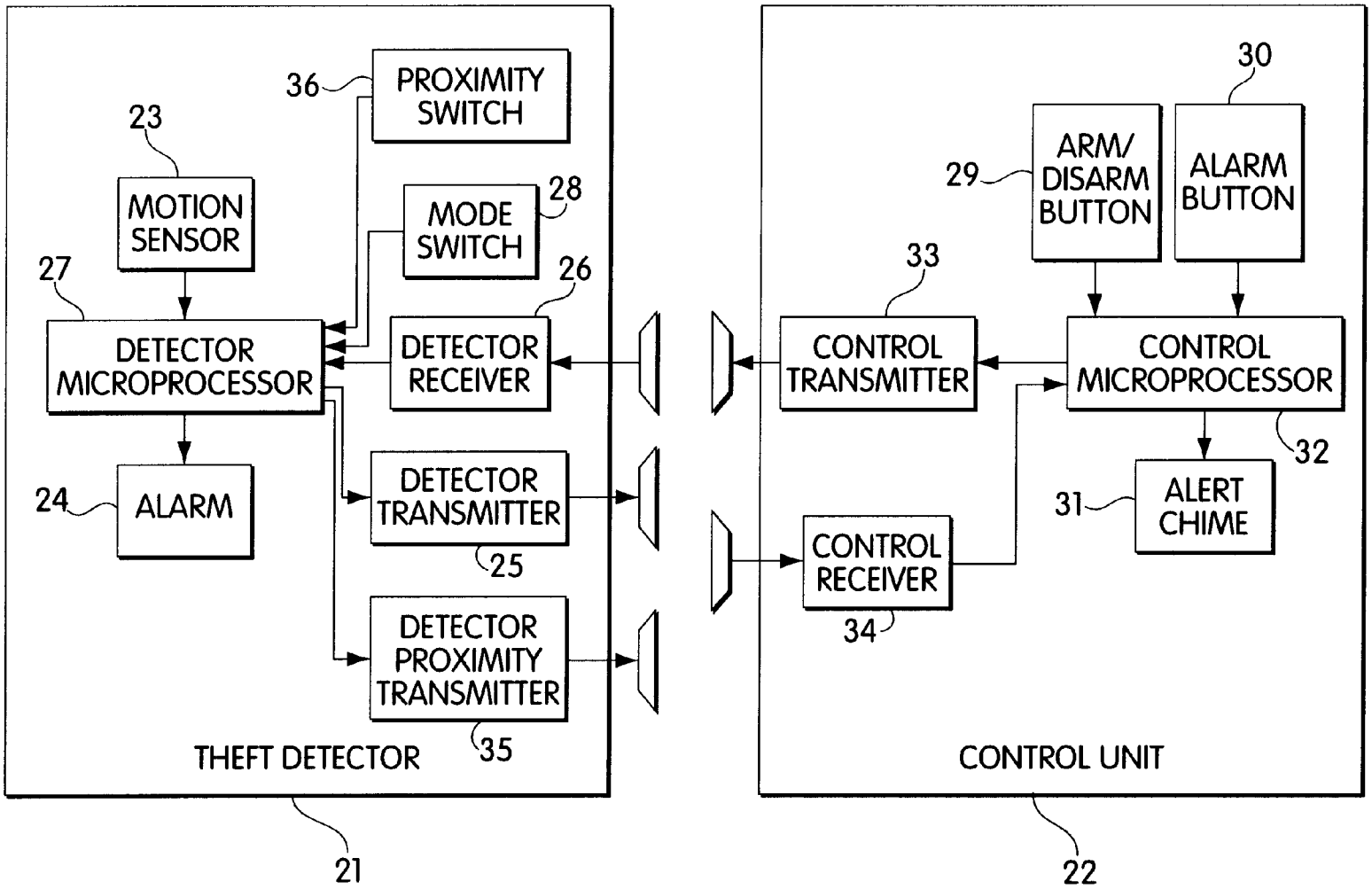
FIG. 7 schematically illustrates the connectivity between the elements of the theft detector unit of FIG. 6 and a control unit.

FIGS. 4 and 7 show a schematic representation of the connectivity and interaction among and between components of theft detector 21 and control unit 22 of FIGS. 3 and 6 respectively. Microprocessors 27 and 32 in theft detector 21 and control unit 22, respectively, play a central role in enabling the functionality of the system. Microprocessors 27 and 32 are capable of performing a wide variety of calculations, making decisions, and controlling other components according to programming instructions stored in firmware which can be customized for different applications. Firmware refers to programs devised to adapt a general purpose microprocessor to a special purpose, such as in the devices disclosed herein, and which are persistently stored in memory accessible to the microprocessor.

Microprocessors 27 and 32 track the status of the other elements of theft detector 21 and control unit 22, respectively, and perform all decision and control functions according to firmware instructions. The microprocessors facilitate the control of fairly complex interactions between components within each unit. Detector microprocessor 27 processes output from motion sensor 23 and detector receiver 26 and controls the sounding of alarm 24 and the transmission of signals through detector transmitter 25 and proximity transmitter 35. Control microprocessor 32 processes output from arm/disarm button 29, alarm button 30, and control receiver 34 and controls the activation of alert speaker 31 and the transmission of signals through control transmitter 33.

In addition to decision and control functions, microprocessors (27, 32) encode and decode the signals exchanged by radio transmitters (25, 33, 35) and receivers (26, 34), respectively, of theft detector 21 and control unit 22. Encoded signals enable the theft detector system to generate a multiplicity of unique messages between units on a single frequency and create system identification so that multiple theft detector systems can operate in the same vicinity without interference. Additionally, the system identification makes it difficult to defeat the theft detection system by simply disarming the theft detector with a similar control unit. For each transmitted signal, microprocessor 27 or 32 encodes a theft detector system identifier, which is shared by the paired theft detector 21 and control unit 22, and a signal identifier, which identifies the signal being transmitted.

Similarly, when a signal is received by receiver 26 or 34, microprocessor 27 or 32 decodes the system identifier and signal identifier. Theft detector 21 and control unit 22 respond only to signals that contain the pairs system identifier. Some embodiments may further encode a unit identifier with the signal whereby a family of theft detector units sharing a single system identifier may be individually addressed and controlled by a single control unit sharing the same system identifier but having means to select the unit identifier.

Power management is another function of microprocessors (27, 32). Commercially available microprocessors, such as the PIC 16C56 microprocessor from Microchip, located in Phoenix, Ariz., include features specifically designed to reduce power consumption, thereby prolonging battery life. In one embodiment, microprocessors (27, 32) provide power to the components they interact with in the respective units only when necessary to perform a specific function. This minimizes the energy consumed by those components. In addition, the microprocessors themselves feature a low power mode in which they consume only a very small current, typically a few micro-amperes. The power requirement is low enough in this mode that battery life is essentially unaffected by the current draw of the microprocessor connected continuously in this mode.

Microprocessors (27, 32) can be programmed to enter the low power or sleep mode whenever idle and awaken periodically, as often as several times per second, to test for control signals or other output from the components with which the respective microprocessors interact. In normal operation the time required to scan for inputs can be quite small compared to the sleep time. If no inputs are detected the system uses only a small fraction of the power required for continuous scanning for inputs. For example, in one embodiment, the microprocessor sleeps for 200 milliseconds, and the time required to test for signals and inputs may be 20 milliseconds in some active modes, reducing power requirements by approximately 90% compared to continuous powering of all components.

Theft detection system 20 has two states, armed and disarmed. A status bit in the memory of each microprocessor (27, 32) indicates the current state. The owner can change the arm/disarm state by depressing arm/disarm button 29 of control unit 22.

When arm/disarm button 29 is pressed, control microprocessor 32 causes control transmitter 33 to send an encoded signal, arm or disarm, according to the current value of its status bit. If the control microprocessor 32 status bit currently indicates that the system is armed, control microprocessor 32 causes control transmitter 33 to send a disarming signal, or if the status bit indicates that the system is disarmed control transmitter 33 sends an arming signal.

Theft detector 21 can be configured to only enter the armed state when mode switch 28 is in the on position. When detector receiver 26 receives an arming signal from control transmitter 33, detector microprocessor 27 changes its status bit to indicate that the system is armed and then causes detector transmitter 25 to return coded arming confirmation signal. When the arming confirmation signal is received by control receiver 34, control microprocessor 32 sets the control microprocessor 32 status bit to indicate the armed state.

A similar process is followed to place theft detection system 20 in the disarmed state from the armed state. When detector receiver 26 receives a disarming signal from control transmitter 33, detector microprocessor 27 changes its status bit to indicate that the system is disarmed and then causes detector transmitter 25 to return a coded disarming confirmation signal. When the disarming confirmation signal is received by control receiver 34, control microprocessor 32 sets the control microprocessor 32 status bit to indicate the disarmed state.

Generally, some form of feedback acknowledging arming or disarming is reassuring to the owner. In the preferred embodiment, when its memory status bit changes state (armed or disarmed), detector microprocessor 27 causes alarm 24 to produce two brief tones of changing pitch. Two successive tones of rising pitch indicate a change to the armed state, and two successive tones of falling pitch signal a change to the disarmed state. The two tone indication of the change of state at theft detector 21 may be supplemented or replaced in some embodiments, for example, by visual indicators such as an LED or by similar indicators at control unit 22.

The motion sensing operation of theft detection system 20 occurs when the system is in the armed state. In one embodiment, the detector microprocessor 27 does not check for motion sensor 23 output in the disarmed state. In the armed state, detector microprocessor 27 checks motion sensor 23 for output several times each second. In the embodiment associated with FIGS. 3 and 4, when the briefcase A has been at rest for a period of time, such as when placed on the floor or a counter, detector microprocessor 27 responds to subsequent movement of briefcase A by causing detector transmitter 25 to send an alert signal to control receiver 34. When control microprocessor 32 determines that control receiver 34 has detected an alert signal, it activates alert speaker 31 notifying the owner that briefcase A has moved. In the embodiment associated with FIGS. 6 and 7, when the briefcase A has either been at rest for a period of time, or a predetermined period of time has elapsed, and movement is subsequently detected by motion sensor 23, with the proximity switch 36 activated, the proximity transmitter 35 issues a proximity check signal to the control receiver 34 in the control unit 22. If the relative position of the control unit 22 to the theft detector unit 21 is not within the near field proximity or if the article to which the theft detector unit 21 is subsequently moved out of the near field proximity, the detector transmitter 25 sends an alert signal to the control receiver 34. In response to the alert signal, the alert speaker 31 notifies the owner that the briefcase A has moved out of the near field proximity.

Having been alerted by alert speaker 31, the owner ascertains the cause of the movement and may activate alarm 24 in theft detector 21 by depressing alarm button 30 and thereby prompting control microprocessor 32 to cause control transmitter 33 to send an alarm signal to detector receiver 26. When detector microprocessor 27 determines that detector receiver 26 has detected the alarm signal, it continuously activates alarm 24 until a second alarm signal is received by detector receiver 26. Some embodiments may additionally limit the duration of alarm 24 activation with a timer.

The transmission of an alert signal to control unit 22 is a response that detector microprocessor 27 may initiate when motion is detected, as with the embodiment of FIGS. 3-4, or when motion is first detected and in response to a proximity check signal, a confirmation signal is not returned, as with the embodiment of FIGS. 6-7. Alarm 24, in the travel mode, cannot be activated except by the owner, so the system cannot initiate a false alarm.

A second benefit of sending an alert signal to control unit 22 when theft detector 21 senses movement, or movement and proximity, is that alert speaker 31 can provide a low level of intrusion. The owner can carry the system armed without generating any loud false alarms. The system is made more convenient in normal use by eliminating repeated alerts for the same basic movement. As noted earlier, in the embodiment shown in FIGS. 3-4, motion sensor 23 can create an output with each step when the article is being carried by a person who is walking. Alert suppression prevents the system from generating an alert signal with each step. On the other hand, in the embodiment shown in FIGS. 6-7, the alert signal will not be generated with each step unless after movement is detected and in response to a proximity check signal there is an absence of a confirmation signal from the control unit. Making the system convenient to carry while armed reduces the chance that the owner will forget to arm the system and leave it vulnerable to theft.

Detector microprocessor 27 uses timing information derived from its clock function to determine if output from motion sensor 23 should trigger an alert signal or activate the issuance of a proximity check signal. The control logic used by detector microprocessor 27 to determine whether to send an alert signal is illustrated in the FIG. 5 flow chart. When theft detector 21 is first armed, detector microprocessor 27 resets an internal clock function in step 41. The reset time usually represents the last time motion was indicated, but initially it is reset at arming time so that a reference time-zero ($T_0$) is stored and which may be used in later elapsed time calculations.

After resetting the internal clock function, detector microprocessor 27 initiates a component scan in step 42. The component scan includes several activities, such as checking detector receiver 26 for control signals, that are not relevant to the discussion of alert suppression. The component scan of step 42 also includes logic to exit the depicted loop, for example, if detector receiver 26 detects a disarming signal.

After completing step 42, detector microprocessor 27 checks motion sensor 23 in step 43. If motion is not detected in step 43, detector microprocessor 27 returns to step 42. If motion is detected in step 43, detector microprocessor 27 calculates an elapsed time in step 44 in relation to $T_0$.

The elapsed time calculation of step 44 measures the time that has passed between the previous indication of motion and the current indication of motion. In step 45, the elapsed time is checked to see if it exceeds a predetermined reference time (three seconds in the preferred embodiment). If the elapsed time does not exceed the reference time in step 45, the internal clock function is reset to $T_0$ in step 47 and detector microprocessor 27 returns to step 42. If the elapsed time is greater than the reference time in step 45, an alert signal is transmitted in step 46 before the internal clock function is reset to $T_0$ in step 47 and detector microprocessor 27 returns to the component scan of step 42.

An alert signal is transmitted if the time between two successive indications of motion exceeds the reference time. In other words, if theft detector 21 is stationary for more than the reference time, the next motion can cause an alert. Choosing the reference time involves a compromise between the number of alerts issued during normal activities and the amount of time before the theft detector resets when the protected article is placed at rest. The preferred embodiment uses a reference time of three seconds, and that value is assumed hereafter to clarify the description.

Figure 5:
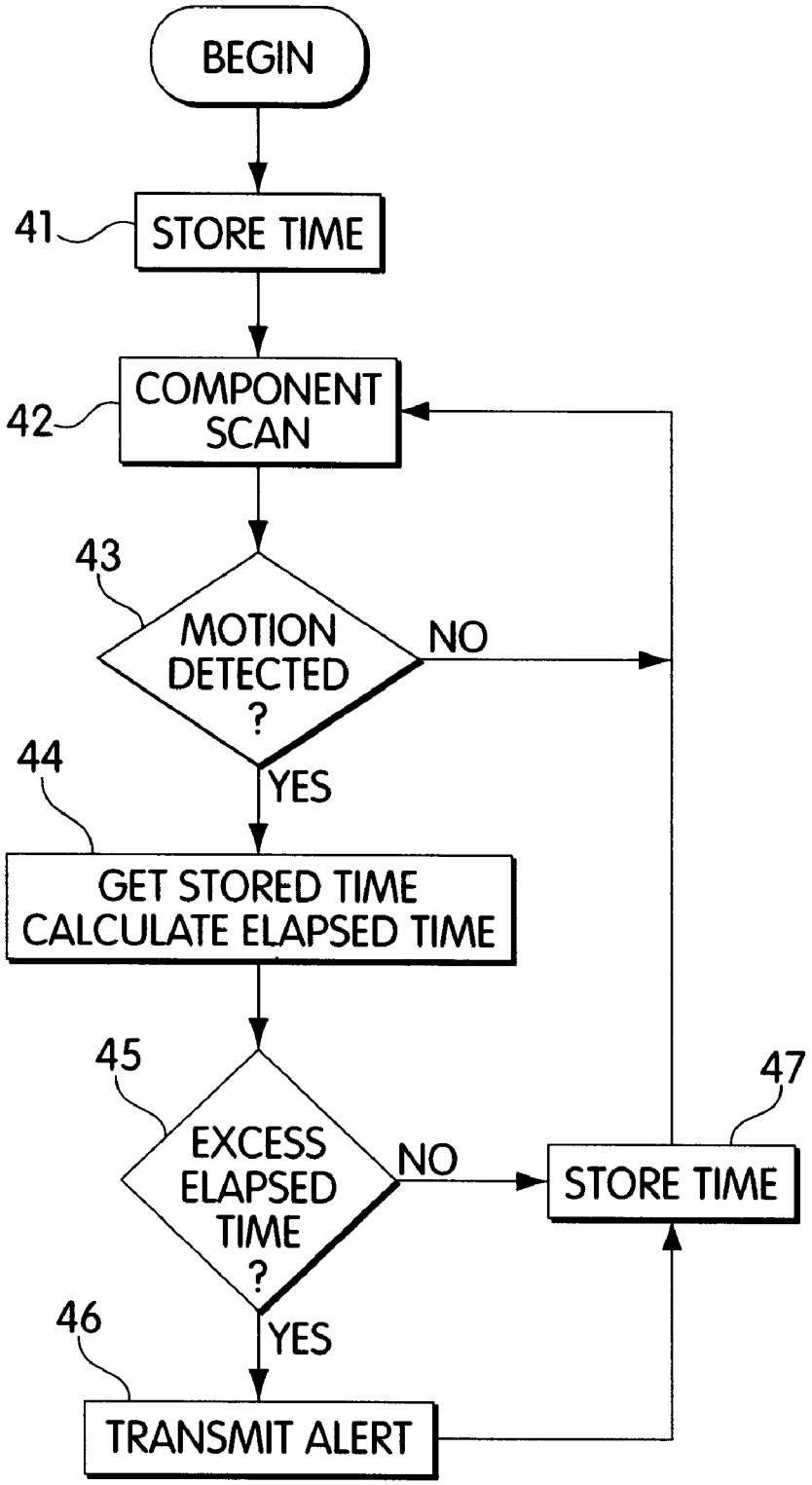
FIG. 5 is a simplified flow chart illustrating alert suppression logic used by the detector microprocessor to reduce the number of alerts transmitted by the theft detector to the control unit.

With the alert suppression logic of FIG. 5, if briefcase A is placed at rest for more than three seconds after which a thief attempts to steal it, movement of briefcase A causes an alert at control unit 22 notifying the owner that briefcase A has been moved. As described earlier, the owner may trigger alarm 24 by pressing alarm button 30 to interrupt the theft and summon help to catch the thief or at least cause the thief to abort the theft attempt. On the other hand, when the owner picks up briefcase A and walks normally, alert speaker 31 will be activated only once because with each step the owner takes motion sensor 23 will indicate movement and the time between steps will typically not exceed three seconds. When briefcase A is again placed at rest, the theft detector will be automatically ready to detect motion after three seconds have passed. With the alert suppression logic, theft detector 21 may be conveniently carried in its armed state at all times and the owner is relieved of the need to arm the system each time briefcase A is placed at rest.

The control logic used by detector microprocessor 27 to determine whether to issue a proximity check signal by the proximity transmitter 35 is illustrated in FIG. SA. This control logic is substantially similar to that shown in FIG. 5. The difference is in the last step 86 wherein in FIG. 8A a proximity check signal step is performed in place of the alert signal step in FIG. 5. Thus, if the elapsed time calculated in step 84 is greater than the reference time in step 85 (i.e., the time between two successive indications of motion exceeds the reference time), a proximity check signal is transmitted in step 86 before the internal clock function is reset to time-zero in step 87. In a preferred embodiment, a series of proximity check signals may be transmitted to extend over a period of time. This period of time preferably can be adjusted to have a desired duration. For instance, the series of proximity check signals may extend over a period of about ten (10) seconds with each signal lasting about 200 milliseconds and being issued at about a one second interval. Detector microprocessor 27 then returns to the component scan of step 82. If the elapsed time in step 84 does not exceed the reference time in step 85, for instance, when the briefcase A is being carried by the owner, the internal clock function is reset to time-zero in step 87 and the detector microprocessor 27 returns to step 82.

Figure 8A:
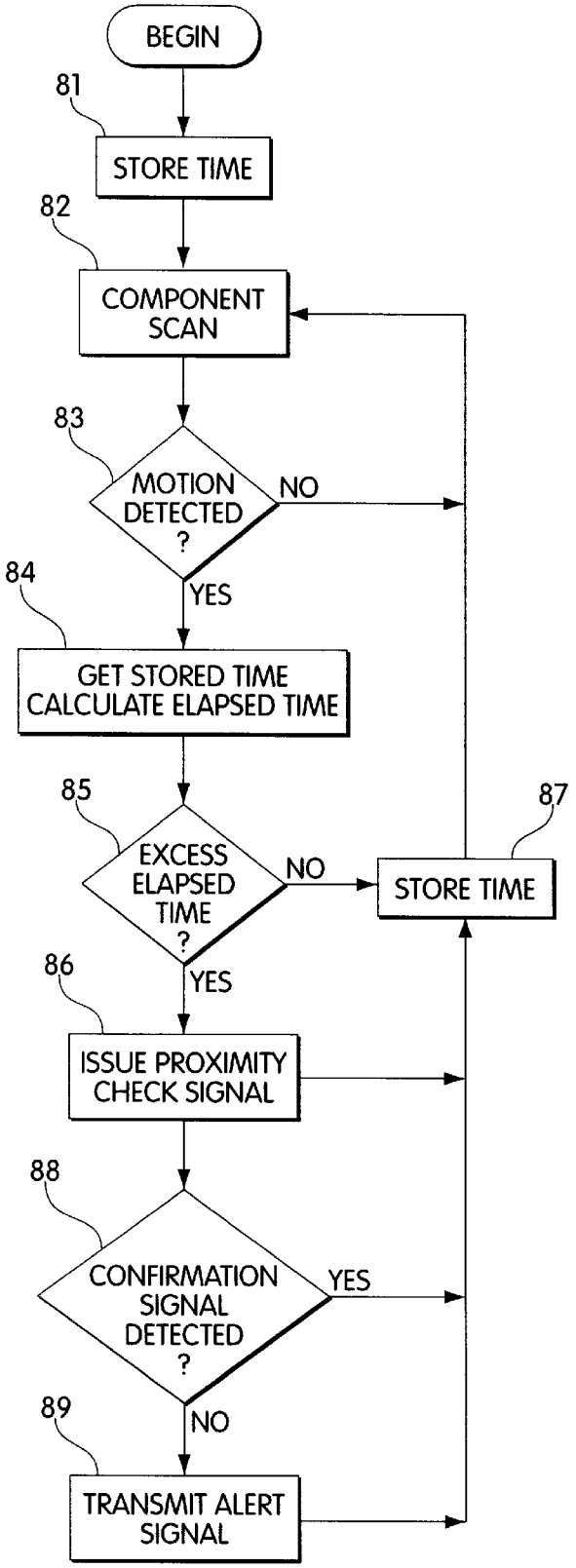
FIGS. 8A-B are flow charts illustrating proximity check signal generation logics used by the detector microprocessor to conserve energy by reducing the number of proximity check signals transmitted.

When employing the control logic of FIG. 8A, the owner would nevertheless be notified of a theft attempt, even if the attempt initially occurs within the near field proximity. In particular, if a briefcase A is placed at rest for more than, for example, three seconds, and theft of the briefcase A is subsequently attempted, movement of the briefcase A causes a series of proximity check signals to be transmitted to the control unit 22. In response to the series of proximity check signals, if the control unit 22 is within the near field proximity, a confirmation signal is sent from the control transmitter 33 to the detector receiver 26 (step 88), and no alert signal will be sent from the detector transmitter 25 to the control unit 22. If the control unit is not within the near field proximity and a confirmation signal is not sent to the detector receiver 26, an alert signal from the detector transmitter 25 is sent to the control receiver 34 (step 89), which in turn permits the owner to be notified of the breach of security through activation of the alert speaker 31. If, however, the control unit 22 is initially within range and is subsequently moved out of range, for example, when the thief carries the briefcase A and runs away from the owner, the series of proximity check signals, the duration of which is preferably sufficiently long, so as to last beyond the period from which the briefcase A is first moved to when the briefcase A is carried beyond the near field proximity by the thief, will permit an alert signal from the detector transmitter 25 to be sent to the control receiver 34, which in turn notifies the owner by activation of the alert speaker 31. Thus, when the thief is still within the near field proximity, a confirmation signal will be sent to the detector receiver 26 and no alert signal will be transmitted. But once the thief has moved beyond the near field proximity, the transmitted series of proximity signal will not be able to elicit a confirmation signal from the control unit 22. An alert signal, in the absence of the confirmation signal, as a result, will be transmitted to the control unit 22 to notify the owner. The owner may then trigger the audio alarm 24 by pressing alarm button 30.

If, on the other hand, the owner causes movement to the briefcase A, for example, picking it up to carry it with him, since the control unit 22 on the owner is within the near field proximity, a confirmation signal is sent from the control unit 22 and an alert signal is not transmitted to notify the owner of a breach of security. When the briefcase A is again at rest, the theft detector will be automatically ready to detect movement after three seconds have passed.

Figure 8B:
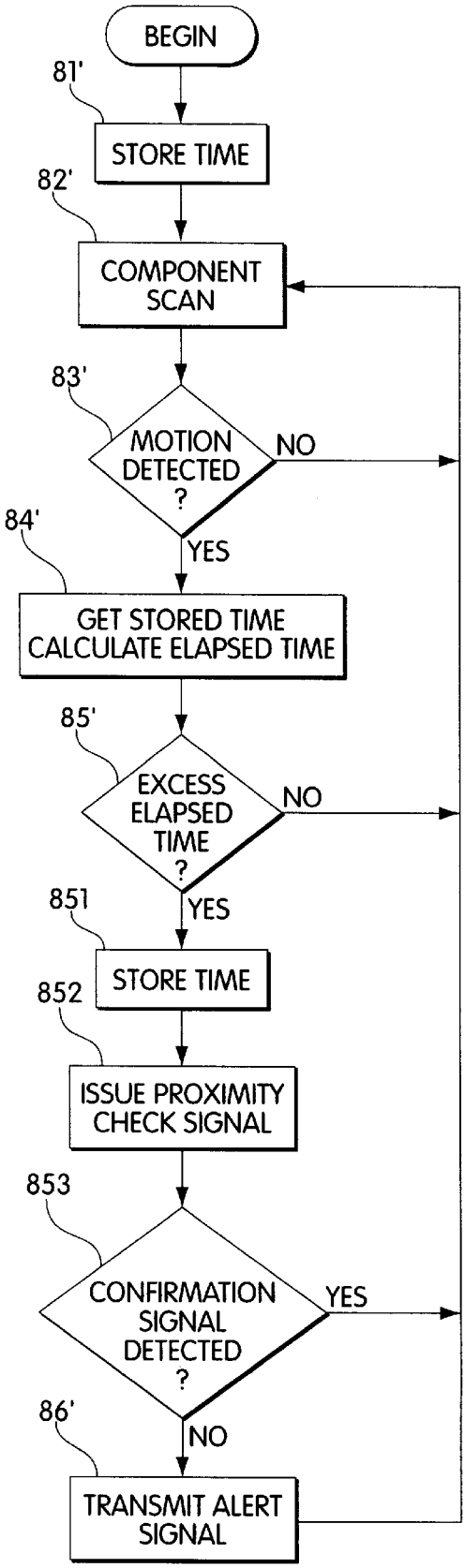

FIG. 8B illustrates another control logic embodiment for use in activating a proximity check signal in response to a detected movement. The pathway is substantially similar to FIG. 8A up to step 85. In the embodiment shown in FIG. 8B, when the system is first armed, the internal clock function is reset to $T_0$ in step 81'. The detector microprocessor then initiates a component scan in step 82'. After step 82' is completed, detector microprocessor 27 checks for movement in step 83'. If movement is detected in step 83', detector microprocessor 27 calculates an elapsed time in step 84' in relation to $T_0$. If the elapsed timed in step 85' does not exceed the predetermined period, the detector microprocessor 27 returns to step 82'. If the elapsed time in step 85' exceeds the predetermined period, the internal clock function is reset to $T_0$ in step 851. This new reset $T_0$ is used to calculate a subsequent elapsed time. Once the internal clock function is reset to $T_0$, a proximity check signal is issued in step 852 by proximity to transmitter 35. In response to the proximity check signal, the detector receiver 26 checks for a confirmation signal in step 853 from the control transmitter 33. If a confirmation signal is received, the detector microprocessor 27 returns to step 82'. If a confirmation signal is not received, by the detector receiver 26, an alert signal is transmitted in step 86' from the detector transmitter 25 to the control receiver 34.

With the control logic of FIG. 8B, if the brief case A, based on the reset $T_0$ (i.e., arming time from which an elapsed time may be later calculated) in step 81', is armed for more than a predetermined period, for instance, three seconds, after which an initial movement is detected, a proximity check signal may be issued. However, before the proximity check signal is issued in response to this initial movement, a new $T_0$ is reset in step 851. The new reset time $T_0$ is important, as it is used to calculate all subsequent elapsed time. Thus, if the initial movement ceases before the elapsed period, the detector microprocessor 27 returns to step 82' and the next movement is calculated based on the new reset $T_0$ in step 851. If movement, on the other hand, continues to be detected, whether as a result of a theft or by the owner, a proximity check signal will be transmitted after the elapsed time has expired, in reference to time-zero stored in step 851. A proximity check signal will continue to be sent out for example, every three seconds, until movement is ceased, at which time the control logic returns to step 81'. Thus, by using the control logic of FIG. 8B to send out a periodic proximity check signal, if movement is initially caused by a thief within a near field proximity and the thief subsequently moves out of the near field proximity, an alert signal will be transmitted to the control unit 22 as soon as there is no response to the proximity signal and as long as the predetermined period, for example, three seconds has passed. The reception of the alert signal subsequently activates the warning alert speaker 31 to notify the owner of the breach of security. If movement is caused by the owner, since the proximity between the control unit 22 and the theft detector unit 21 is maintained, no alert signal will be issued.

Still another feature of the invention is the tamper resistant power mode switch 28. In some applications the invention mode switch 28 may be visible and accessible, for example, if the housing of theft detector 21 is externally attached to an article such as a portable computer so it can be protected while in use in a public place. The tamper resistant switch prevents a thief from using the switch to deactivate theft detector 21 when it is armed, yet still allows the owner to conveniently place theft detector 21 in its low power mode to conserve battery life when not in use.

As noted earlier, detector microprocessor 27 has power management features that make it capable of substantially stopping current flow from the battery. In one embodiment, detector microprocessor 27 is always connected to the battery. Mode switch 28 is connected such that detector microprocessor 27 can check to determine which position it is in, but mode switch 28 cannot interrupt power to detector microprocessor 27.

Theft detector 21 has a low power mode of operation that it enters when it is disarmed and mode switch 28 is placed in the off position. Theft detector 21 can only enter the low power mode from its disarmed state. In low power mode, detector microprocessor 27 awakens from its periodic sleep mode using its power management features, as described earlier, and checks only for a change in mode switch 28 position. Detector microprocessor 27 requires a few microseconds to perform this check, which is less than 0.01% of the 200 millisecond sleep period used in the embodiment described above. The power requirement is so small in low power mode that battery life is largely unaffected by the absence of a power cutoff switch.

When mode switch 28 is in the on position and theft detector 21 is armed, detector microprocessor 27 does not check the position of mode switch 28. If the position of mode switch 28 is changed while theft detector 21 is armed, detector microprocessor 27 does not process the change in switch position, and theft detector 21 remains armed.

Since theft detector 21 cannot enter the low power mode from the armed state, a thief cannot use mode switch 28 to deactivate the system. On the other hand, the owner may place theft detector 21 in its low power mode by disarming the system using control unit 22 before (or after) placing mode switch 28 in its off position. Possession of control unit 22 is necessary to place theft detector 21 in its low power mode. The tamper resistant function of mode switch 28 prevents the system from being placed in low power mode by anyone other than the owner, yet does not require keys or a combination to prevent unauthorized deactivation.

A second active theft detection mode may be selected by placing mode switch 28 in the automatic position. In this mode, theft detector 21 triggers alarm 24 automatically, rather than sending an alert signal to control unit 22, when motion sensor 23 detects motion (embodiment in FIGS. 3-4), or detects motion and there is an absence of a confirmation signal in response to a proximity check signal (embodiment in FIGS. 6-7).

The automatic mode supplements the alarm screening (on) mode in situations where the owner may not be available to screen alarms. The automatic mode also is useful when the owner does not expect to be in contact with the protected article frequently. In automatic mode, alarm 24 is triggered according to an adaptive alarm sequence that varies the severity of the alarm in response to the frequency and duration of motion during a breach of security. An isolated movement causes only a brief warning alarm, but a persistent motion causes a full scale alarm of several seconds duration.

In automatic mode, theft detector 21 may be armed and disarmed just as in alarm screening mode, using control unit 22 to send arming and disarming signals. Mode switch 28 retains its tamper resistance because detector microprocessor 27 does not check for a change in switch position while theft detector 21 is armed. Theft detector 21 must be disarmed to effect a mode change.

With the adaptive alarm, detector microprocessor 27 triggers alarm 24 using a sequence of alarm patterns in succession if motion sensor 23 continues to detect movement or continues to detect movement in absence of a confirmation signal from the control unit 22. The alarm patterns range from a warning sound at the lowest level of the sequence to a full scale alarm of several seconds duration at the highest level of the sequence.

In the preferred embodiment, five alarm levels are defined. The lowest level alarm is a single brief burst from alarm 24 followed by a pause; the second level is two brief bursts in rapid succession followed by a pause, and so on through four levels. Each alarm pattern through level four has a total duration of one second, including the pause which is adjusted in length to create the one second total duration. Level five is a full scale alarm of five seconds duration beyond the last detected movement. Other embodiments may vary pitch and/or volume at each level in addition to or instead of pulsing the alarm, and timing and number of levels also may be different.

Detector microprocessor 27 tracks the alarm level and sounds the alarm pattern that corresponds to the current alarm level when motion is detected. The alarm level is increased each time the alarm is sounded in response to motion sensor 23 output until the alarm level reaches its highest value. Each lower level alarm pattern is allowed to finish before motion sensor 23 is checked again, so a minimum of four seconds is required to reach the highest level alarm. Once at the highest level alarm, motion sensor 23 is checked continuously and the alarm timer is reset each time motion is detected. At the highest alarm level the alarm always continues to sound for a full five seconds beyond the last detected motion.

In the automatic mode, alarm 24 sounds automatically when the motion sensor 23 detects motion (embodiment in FIGS. 3-4) or when the motion sensor 23 detects motion and there is an absence of a confirmation signal from the control unit 22 (embodiment in 25 FIGS. 6-7), and always discontinues sounding when the current alarm pattern is complete unless further motion is detected. After a delay time of four seconds in the preferred embodiment without further motion, detector microprocessor 27 reduces the alarm level by one without triggering alarm 24. Detector microprocessor 27 never triggers alarm 24 when the alarm level is decreased. Thus, if theft detector 21 is left motionless for a sufficiently long period after an alarm, subsequent movement triggers the lowest level alarm pattern. In one embodiment, the alarm level decreases to its lowest value within sixteen seconds after a full scale alarm. Specifically with the embodiment associated with FIGS. 6-7, if the theft detector 21 is left motionless after the alarm 24 has been activated, either automatically or by the owner activating the alarm button 30, the system of the present invention may be designed so that once the control unit 22 has been brought to within the near field proximity, the alarm 24 is automatically silenced.

In use, if the protected article includes a theft detector 21 which is armed and in the automatic mode, a warning burst may be automatically generated by alarm 24 without active triggering by the owner. If the protected article is then left stationary, the alarm immediately stops. This gives the cause of the movement a chance to stop before theft detector 21 responds with a full scale alarm. If the protected article is jostled in a crowded area, the disturbance is minimal. If a thief attempts to steal the protected article, the response is immediate. In the embodiment of FIGS. 6-7, the response is immediate once the article has been taken beyond the near field proximity. If the thief ignores the warning and continues the theft attempt, the alarm escalates quickly to a full scale alarm, summoning help to stop the theft attempt and/or catch the thief.

The present invention also contemplates an embodiment wherein a proximity transmitter 35 is used without the use of a motion sensor 23. In such an embodiment (not shown), a proximity check signal may be generated having a known signal pattern to generate a near field proximity. In a preferred embodiment, the proximity signal may be generated according to a timing pattern. If the control unit 22 is within the proximity range, the proximity signal will be received and a confirmation is transmitted to the detector receiver 26. Because a confirmation is received by the theft detector 21, an alert signal will not be transmitted to the control unit 22 to notify the owner that the distance between the control unit 22 and the theft detector is beyond the near field proximity. If, on the other hand, the control unit 22 is outside the proximity range, a confirmation signal will not be returned from the control transmitter to the detector receiver 26. In the absence of the confirmation signal, an alert signal from the detector transmitter 25 is transmitted to the control receiver 34. The alert speaker 31 is thereafter activated by the receipt of the alert signal to notify the owner that the distance between the control unit 22 and the theft detector is greater than the near field proximity. If the theft detector in this embodiment is set on automatic mode, once the control unit 22 is moved beyond the near field proximity and a confirmation signal is not returned from the control unit 22 to the theft detector, the alarm 24 may be set to sound automatically. The alarm 24 may be shut off automatically when the owner returns to within the near field proximity or when the owner actively deactivates the alarm using the control unit 22.

The embodiment just described clearly accomplishes the objectives of the invention. A number of variations can easily be envisioned. For example, some embodiments may include only one of the alarm functions described herein. An embodiment including just the adaptive alarm function requires only one way communication for arming and disarming signals from the control unit and may be more economical to produce. Other embodiments including both modes of operation may select the active mode using the control unit, so the mode switch needs only one active position.

Figure 9:
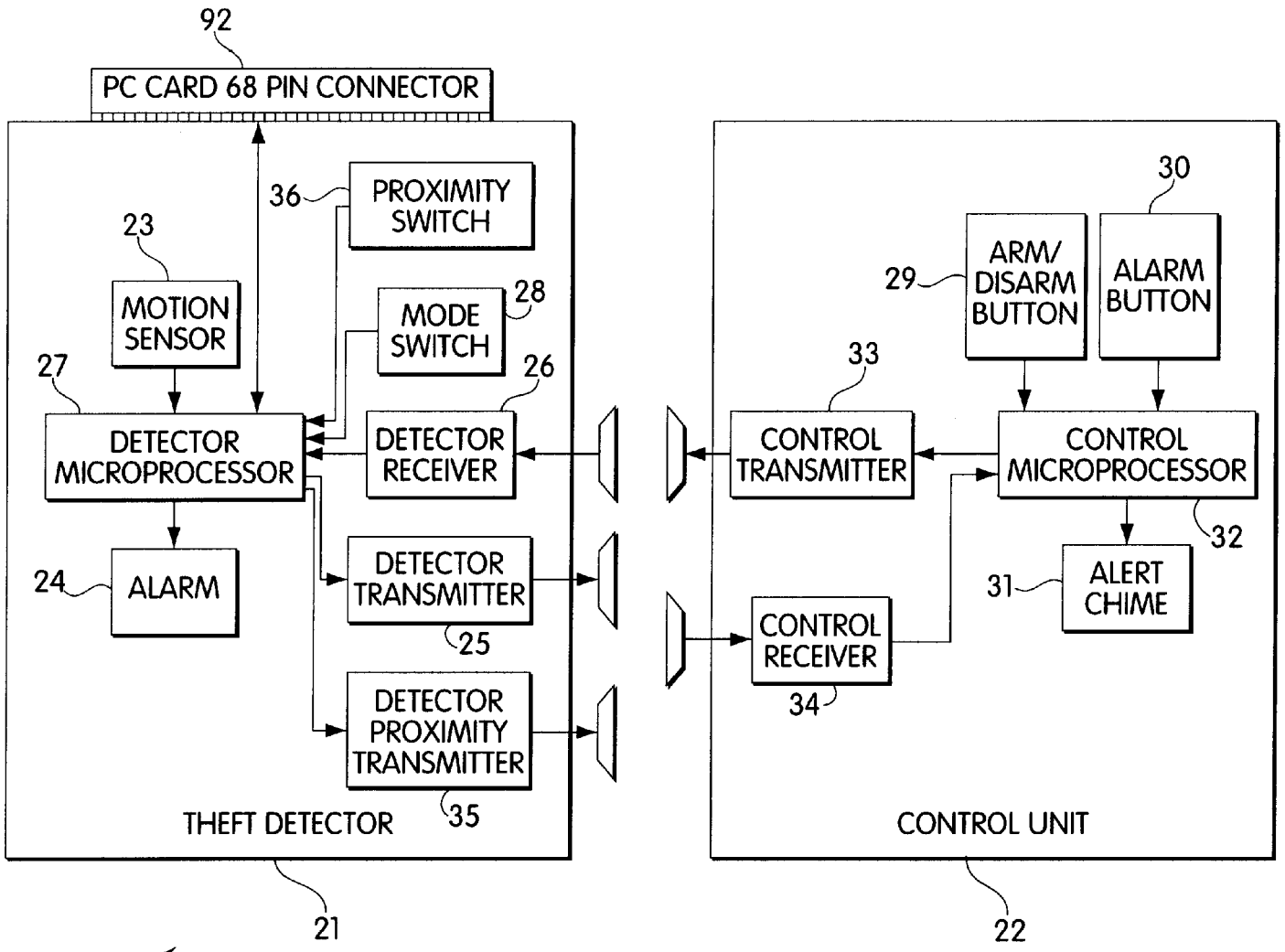
FIG. 9 illustrates a theft detector unit packaged on a PC card for use in accordance with one embodiment of the present invention.

Other variations adapt the system for convenient protection of particular articles. One such variation houses the invention as an integral part of the article being protected. For example, in one such variation the theft detector is built into a hard sided carrying case such that the alarm sounds through an opening in the case to allow full sound volume outside the case. In another variation of this type, the theft detector can be packaged on a PC Card to be installed in a laptop or other computer, or a personal organizer. The use of a movement sensor alone, a combination movement sensor and proximity sensor, or a proximity sensor alone, as described above, may be adapted and packaged on a PC Card for use with the embodiment of FIG. 1. The PC card package 90, looking now at FIG. 9, can include an interface, such as pin connector 92 for connecting to a PC card interface of a computer, and may extend outside the slot to obscure the manual eject button, and to position the transmitter and receiver antennas external to the laptop case. Additionally, the PC Card interacts, by way of the pin connector 92, with software in the computer to disable the software eject while the theft detector is armed. The PC Card package has its own auxiliary battery power supply so that it can operate even when the laptop battery pack has been drained. In a similar variation the theft detector is housed integrally within the laptop computer, rather than as a separable PC card.

In addition, the embodiment combining the use of a motion sensor and a proximity sensor may be adapted so that the control unit may be affixed to, for example, an office wall, such that when the article to which the theft detector unit is attached is removed from the office, an alarm is sounded. The control unit or theft detector unit may also include components necessary for linking to conventional communication systems, for example, cell phones, satellite paging systems, or other wireless notification systems known in the industry, to notify the owner of a theft attempt.

Those skilled in the art will know or be able to ascertain using no more than routine experimentation, many equivalents to the embodiments and practices described herein. For example, the control unit can be housed in a manner convenient to be carried by the owner and the control unit housing may include a provision to be carried in a pocket, attached to a key ring, strapped to the wrist, hung on a necklace, or clipped, pinned, or tied to a belt, belt loop, lapel, watchband, or other article of clothing. The theft detector unit housing may include a similar range of options for being carried with or attached to the protected article and may further include options to house the theft detector unit as an integral part of the protected article.

In addition, a motherboard carrying a theft detection unit can include a dedicated CPU or microcontroller, optionally being a low power drain device, capable of operating the theft detector unit without the high-power demands of the motherboard general purpose CPU. The systems described herein, in substitution or addition to sounding the alarm, can lock the hard drive, delete selected files, connect to a GPS system, or employ cellular or other known technology. Additionally, the theft detector can operate the computer display to cause a splash screen to appear that provides information about where to return the stolen article. A further additional feature allows the control unit to be operated as a panic button that employs the theft detector alarm to call for aid.

Accordingly, it will be understood that the invention is not to be limited to the embodiments disclosed herein, but is to be understood from the following claims, which are to be interpreted as broadly as allowed under the law.

We claim:

1. An anti-theft system comprising:

(a) a control unit having:

a control transceiver capable of transmitting and receiving data signals; and an activation element coupled to the control transceiver and capable of directing the control transceiver to transmit an alarm signal representative of a command to activate an alarm; and (b) a theft detector having:

a motion detector for generating a movement signal in response to a detected movement;

a proximity transmitter coupled to the motion detector for transmitting, in response to the detected movement, a proximity signal having a known approximate near field proximity, to the control transceiver;

an alarm; and a detector transceiver coupled to the motion detector and the alarm for providing bi-directional transfer of data signals, the detector transceiver, in the absence of a confirmation signal from the control transceiver to indicate that the control unit is within the near field proximity, being capable of:

(A) in a first mode, automatically activating the alarm to indicate that an article to which the theft detector is coupled has moved, or (B) in a second mode, (i) transmitting to the control transceiver an alert signal in response to the movement signal, and (ii) activating the alarm in response to the alarm signal received from the control transceiver, which alarm signal may be generated by a user triggering the activation element of the control unit in response to the alert signal, to indicate that security of the article has been compromised.

2. An anti-theft system as set forth in claim 1, further including a mode switch to selectively provide the system with either the first mode of alarming or the second mode of alarming.

3. An anti-theft device as set forth in claim 1, wherein the control unit further includes a warning device coupled to the control transceiver, the warning device capable of being activated in response to the alert signal from the control transceiver to indicate to a user that security of the article has been compromised.

4. An anti-theft system as set forth in claim 1, wherein the theft detector includes an interface for connecting to a PC card interface of a computer.

5. An anti-theft system as set forth in claim 1, wherein the detector transceiver includes a transmitter component separate and distinct from a receiver component.

6. An anti-theft system as set forth in claim 5, wherein the transmitter component of the detector transceiver and the proximity transmitter are incorporated into a single unit that is capable of switching between functions.

7. An anti-theft system as set forth in claim 5, wherein the transmitter component is carried on a computer motherboard.

8. An anti-theft system as set forth in claim 5, wherein the receiver is carried on a computer motherboard.

9. An anti-theft system as set forth in claim 1, further including a timing device for measuring a predetermined period of time between detected movements before a proximity signal is transmitted.

10. An anti-theft system as set forth in claim 1, further including a system for measuring and comparing the strength of the proximity signal sent from the proximity transmitter to the strength of the proximity signal received by the control transceiver to determine whether the control unit and the theft detector are within the near field proximity.

11. A method for remotely providing security to an article, the method comprising:

providing the article with (a) a remote device and (b) a device attached to the article, the device having a motion detector, a proximity transmitter, and an alarm, and detecting whether there is a movement of the article using the motion detector;

in response to the movement, determining whether the article is within a near field proximity of the remote device using the proximity transmitter; and in the absence of a confirmation signal from the remote device to indicate that the article is within the near field proximity of the remote device, causing the alarm to generate a signal to indicate that security of the article has been compromised.

12. A method as set forth in claim 11, wherein the step of determining further includes the steps of:

providing a near field proximity within which the remote device and the attached device should remain relative to one another;

determining a distance separating the remote device from the attached device; and comparing that distance to the near field proximity.

13. A method as set forth in claim 11, wherein the step of determining further includes the steps of:

measuring a proximity signal strength received by the remote device;

comparing the received proximity signal strength to a transmitted proximity signal strength from the proximity transmitter;

calculating a range between the proximity transmitter and the remote device; and comparing the range calculated to the near field proximity.

14. A method as set forth in claim 11, wherein the step of causing the alarm to generate a signal further includes the steps of:

sending an alert signal directed to the remote device; and in response to the alert signal, transmitting from the remote device a signal to the alarm so as to generate an audio signal to indicate that security of the article has been compromised.

15. A method as set forth in claim 11, wherein the step of causing the alarm to generate a signal further includes the steps of:

triggering a sequential pattern of audio signals wherein the pattern successively advances from a low level audio signal to a high level audio signal.

16. An anti-theft system comprising:

(a) a control unit having:

a control transceiver capable of transmitting and receiving data signals; and an activation element coupled to the control transceiver and capable of directing the control transceiver to transmit an alarm signal representative of a command to activate an alarm; and (b) a theft detector having:

a proximity transmitter for transmitting a proximity signal having a near field proximity to the control transceiver;

an alarm; and a detector transceiver coupled to the proximity transmitter and the alarm for providing bi-directional transfer of data signals, the detector transceiver, in the absence of a confirmation signal from the control transceiver to indicate that the control unit is within the near field proximity, being capable of (i) transmitting to the control transceiver an alert signal to indicate to a user that an article is no longer within the near field proximity, and (ii) activating the alarm in response to the alarm signal received from the control transceiver, which alarm signal may be generated by a user triggering the activation element of the control unit in response to the alert signal.

17. An anti-theft system as set forth in claim 16, wherein the theft detector includes an interface for connecting to a PC card interface of a computer.

18. An anti-theft system as set forth in claim 16, wherein the detector transceiver includes a transmitter component separate and distinct from a receiver component.

19. An anti-theft system as set forth in claim 18, wherein the transmitter component is an RF transmitter and the receiver is an RF receiver.

20. An anti-theft system as set forth in claim 18, wherein the transmitter component of the detector transceiver and the proximity transmitter are incorporated into a single unit that is capable of switching between functions.

21. An anti-theft system as set forth in claim 18, wherein the transmitter component is carried on a computer motherboard.

22. An anti-theft system as set forth in claim 18, wherein the receiver is carried on a computer motherboard.

23. An anti-theft system as set forth in claim 16, further including, at least in the control unit, a device for measuring and comparing the strength of the proximity signal sent from the proximity transmitter to the strength of the proximity signal received by the control transceiver to determine whether the control unit and the theft detector are within the near field proximity.

24. An anti-theft system as set forth in claim 16, wherein the control unit further includes a system identifier for generating a system identification signal representative of a control unit and at least one theft detector.

25. An anti-theft device as set forth in claim 16, wherein the control unit further includes a warning device coupled to the control transceiver, the warning device capable of being activated in response to an alert signal from the control transceiver to warn the user that the article is no longer within the near field proximity.

26. An anti-theft system as set forth in claim 16, further including a mode switch for selectively entering a low power mode for reducing power consumption.

27. A method for remotely providing security to an article, the method comprising:

providing the article with (a) a remote device and (b) an attached device having a proximity transmitter and an alarm, and determining whether the article is within a near field proximity relative to the remote device using the proximity transmitter; and in the absence of a confirmation signal from the remote device indicating that the article is within the near field proximity to the remote device, causing an alert signal to be directed to the remote device; and transmitting a signal from the remote device to the alarm so as to generate a signal to indicate the article is no longer within the near field proximity to the remote device.

28. A method as set forth in claim 27, wherein the step of determining further includes the steps of:

providing a near field proximity within which the remote device and the attached device should remain relative to one another;

determining a distance separating the remote device from the attached device; and comparing that distance to the near field proximity.

29. A method as set forth in claim 27, wherein the step of determining further includes the steps of:

measuring a proximity signal strength received by the remote device;

comparing the received proximity signal strength to a transmitted proximity signal strength from the proximity transmitter;

calculating a range between the proximity transmitter and the remote device; and comparing the range calculated to the near field proximity.

30. A method as set forth in claim 27, wherein the step of causing the alarm to generate a signal further includes the steps of:

triggering a sequential pattern of audio signals wherein the pattern successively moves from a low level audio signal to a high level audio signal.

* * * * *